US006105185A

United States Patent [19]

DiRocco

[11] Patent Number: 6,105,185

[45] Date of Patent: Aug. 22, 2000

[54] ADJUSTABLE COUNTERBALANCE ASSEMBLY FOR PANEL BED

[75] Inventor: Thomas R. DiRocco, Maples, Fla.

[73] Assignee: GTW Space Systems, L.L.C., Largo, Fla.

[21] Appl. No.: 09/190,726

[22] Filed: Nov. 12, 1998

Related U.S. Application Data

[60] Provisional application No. 60/065,140, Nov. 12, 1997.

[51] Int. Cl.[7] ..... A47C 19/00

[52] U.S. Cl. ..... 5/164.1; 5/136

[58] Field of Search ..... 5/136, 164.1, 133, 5/159.1

[56] References Cited

U.S. PATENT DOCUMENTS

| | | | |
|---|---|---|---|
| 4,370,766 | 2/1983 | Teague, Jr. | 5/133 |
| 4,589,152 | 5/1986 | Pakosh | 5/164.1 |
| 5,033,134 | 7/1991 | Burchett | 5/133 |
| 5,353,452 | 10/1994 | Rulis | 5/136 |

*Primary Examiner*—Terry Lee Melius
*Assistant Examiner*—James M Hewitt
*Attorney, Agent, or Firm*—Rader, Fishman, Grauer & McGarry, an Office of Rader, Fishman & Grauer PLLC

[57] ABSTRACT

A spring counterbalanced folding wall bed having a vertically disposed shell including side walls spaced from each other and a bed frame pivotally mounted to the shell for movement between an open position and a closed position. In the open position the bed frame is substantially horizontal; in the closed position the bed frame is substantially vertical and between the side walls. A spring is mounted between a head end of the bed frame and one of the side walls and is biased to retain the bed in the closed position. One end of the spring is secured to the head end by a first pivotal connection and the other end of the spring is secured to the side wall by a second pivotal connection. At least one of the first and second pivotal connections are movable so that the length of the spring can be adjusted, whereby the spring force can be adjusted.

3 Claims, 4 Drawing Sheets

ADJUSTABLE COUNTERBALANCE ASSEMBLY FOR PANEL BED

This application claims the benefit of U.S. Provisional Application Ser. No. 60/065,140 filed on Nov. 12, 1997.

BACKGROUND OF THE INVENTION

1. Field of the Invention

This invention relates to folding bedsteads and bed assemblies and, more particularly, to adjustable counterbalance assemblies for panel beds.

2. Related Art

Folding bedsteads or bed frame assemblies have earned a reputation as being cumbersome, complex and generally unreliable. A typical panel bed assembly includes a cabinet connected to or built into a wall and may include a plurality of drawers, shelves or the like. The panel bed conventionally includes a bed frame connected within the cabinet and movable between a horizontal and a vertical position.

The bed frame typically includes a plurality of legs extending therefrom to vertically support the bed on the floor in the open position and handles to open the bed. A counterbalance mechanism connected between a head rail of the bed frame and the cabinet balances the weight of the bed frame so that the bed frame is easier to raise into a closed position and so that the effect of the force of gravity encountered in opening the bed frame is reduced.

Counterbalance mechanisms commonly used in the art include springs, gas struts, or torsion rods. When a bed is being moved between its open and closed positions, it should not be necessary for the operator to exert any substantial force to initiate movement. Therefore, the counterbalancing forces should be easily overcome by the person initiating the movement of the panel from its open position to its closed position or vice versa. Moreover, the weight of the bed can vary depending on the particular front panel and mattress that is installed upon the bed frame. Friction is also an important factor in that it can add to the force that the counterbalancing mechanism must exert during the lifting and opening of the bed.

The connection of the bed frame to the shell or cabinet is typically unreliable and complex. In particular, the length of the counterbalancing mechanism must be correct in order to provide control of the flow of the bed frame from a vertical, or closed, to a horizontal, or open, position. The mounting point of the counterbalancing mechanism on both the cabinet and the bed frame must often be adjusted upon installation to accommodate the various sizes and weights of beds, mattresses and front panels so that an appropriate flow of the bed from its open to closed or closed to open position can be achieved. Also, as the counterbalancing mechanism is used over time, it will lose some of its power, and thus further requiring adjustment or replacement. Replacing the counterbalancing mechanism, however, is an expensive way to combat this problem.

SUMMARY OF THE INVENTION

These and other disadvantages of the prior art are overcome by the provision of an adjustable bracket assembly for the counterbalancing mechanism. By providing slots for adjustment in both the attachment of the counterbalancing mechanism to the cabinet and the connection to the bed frame, the bed may be fine tuned for appropriate flow upon installation of the counterbalancing mechanism and, as the counterbalancing mechanism loses power over time and use, the counterbalancing mechanism's length may be adjusted by simply moving the mounting point in the bracket rather than replacing the entire counterbalancing mechanism as is required in the prior art.

DETAILED DESCRIPTION

Figures 1, 3:
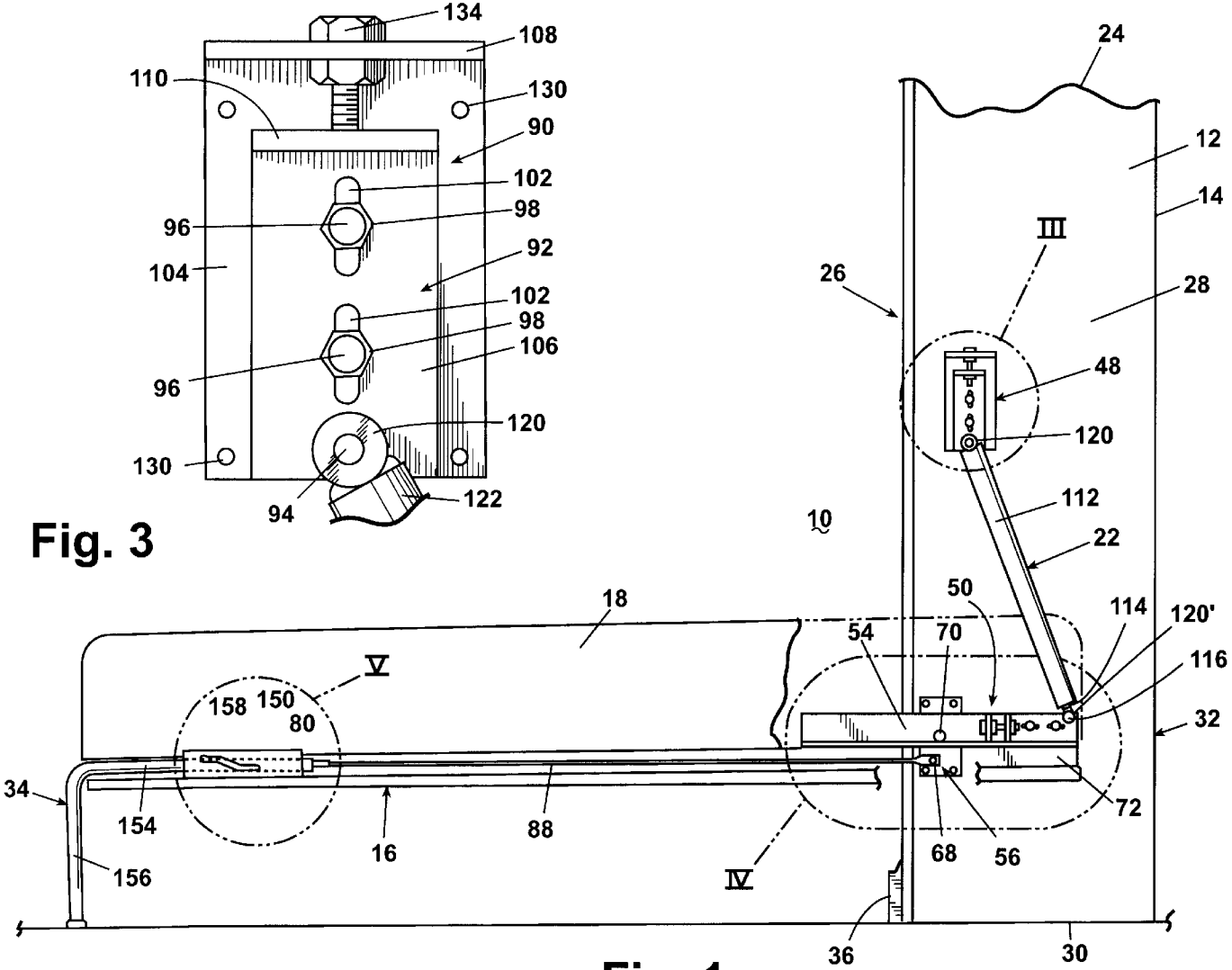
FIG. 1 is a partially sectioned side elevational view of a panel bed with an adjustable counterbalance assembly in accordance with the invention.
FIG. 3 is an enlarged side elevational view of the area bounded by phantom line III in FIG. 1.
Figure 2:
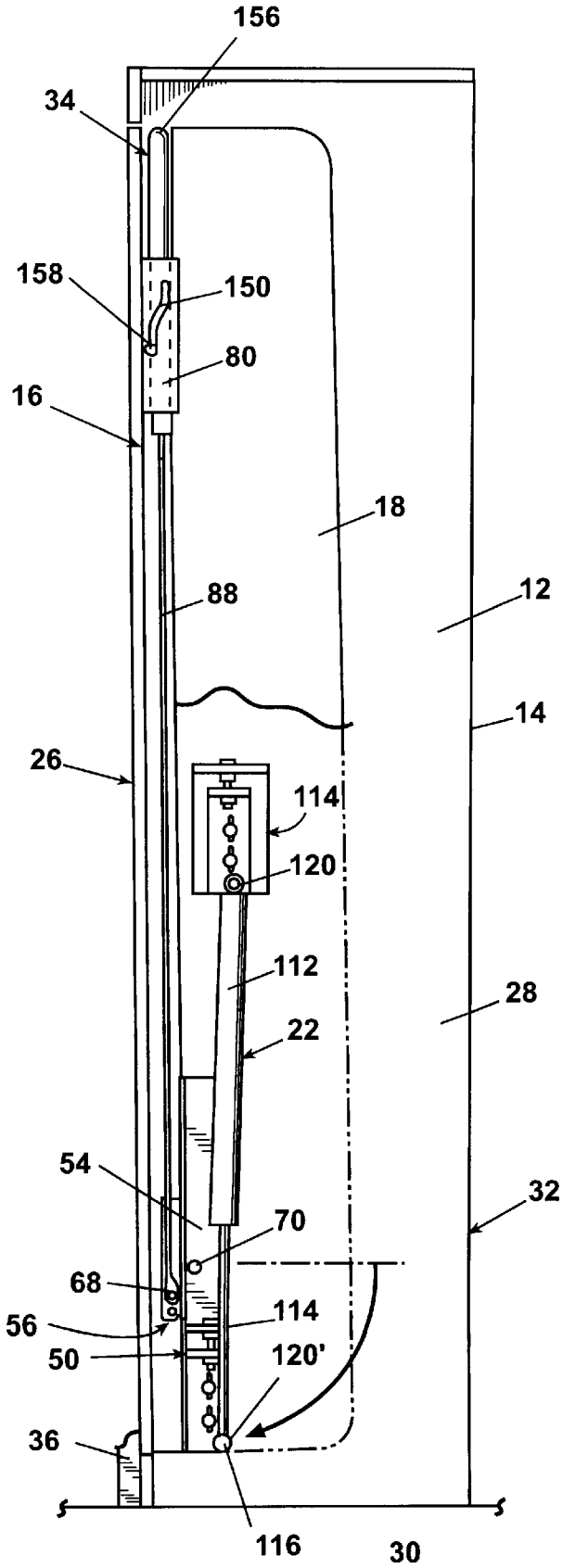
FIG. 2 is a side elevational view similar to FIG. 1 with the bed shown in the closed position.

A panel bed assembly 10, as shown in FIGS. 1 and 2, embodying the present invention includes a shell 12, normally attached to a room wall 14, to which a bed frame 16 for receiving a mattress 18 is pivotally attached and rotates between a substantially vertical or closed position and a substantially horizontal or open position. The weight of the bed frame 16 is counterbalanced by a pair of springs 22 (here illustrated as gas springs) which serve to bias the bed frame 16 toward the closed position. The gas springs 22 are secured between the bed frame 16 and the shell 12 by adjustable bracket assemblies 50 and 48, respectively, as best illustrated in FIG. 1.

The box-shaped shell 12 includes at least a pair of side walls 28, each of which is secured to a back wall 32 or directly to the room wall 14. In any event, the shell 12 is secured to the adjacent room wall 14. The pair of side walls are parallel to and spaced from each other sufficiently for the bed frame 16 to nest between them. For illustration here, only one is shown. Extending between the side walls 28 at the floor 30 and the front of the shell 12 is a facia 36. The facia 36 limits the movement of the bed frame 16 in the shell 12 from rotating past the vertical position (approximately 90° from the horizontal position). The adjustable shell bracket assembly 48 is secured to each side wall 28 of the shell 12 for mounting one end of a gas spring 22. The adjustable bed bracket assembly 50 is secured to each side of the bed frame 16 for attaching another end of the gas spring 22.

The gas springs 22 bias the bed frame 16 toward a vertical position in accordance with well-known conventional devices. As shown in FIGS. 1 and 2, each gas spring 22 is partially enclosed within a corresponding sheath 112 and includes a reciprocally movable piston arm 114. The piston arm 114 extends from a base 120 of the gas spring 22 and includes a mounting eyelet 116 at a distal end thereof. The mounting eyelets 116 pivotably mount the piston arm 114 of each gas spring 22 to the bed bracket assembly 50. Each base 120 of the gas springs 22 is pivotably mounted to the adjustable shell bracket assembly 48.

Figure 4:
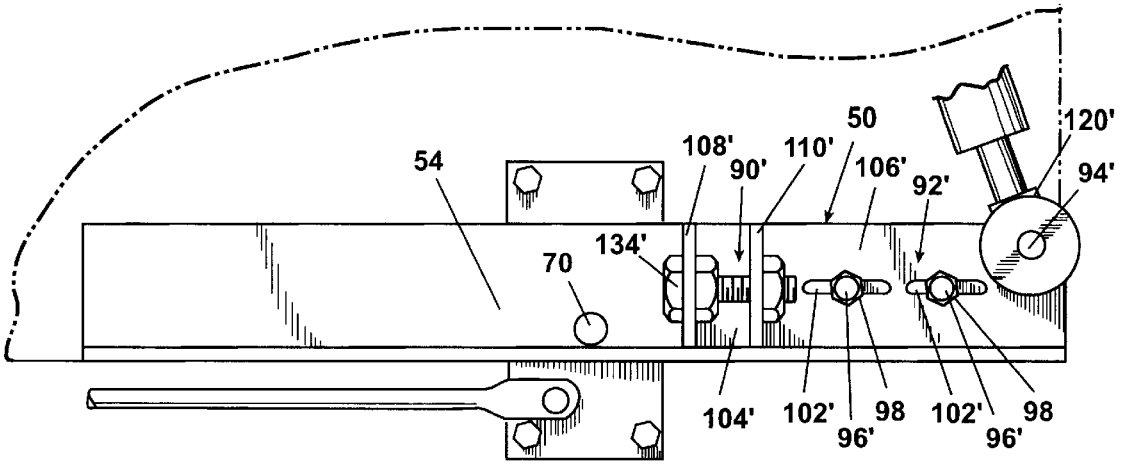
FIG. 4 is an enlarged side elevational view of the area bounded by phantom line IV in FIG. 1.

The bed frame 16 is rotatably mounted within the shell 12 by a pair of pivot assemblies 54, one side of which is as shown in FIGS. 1, 2, and 4. The bed frame 16, which has a head end 72 and a foot end 74, includes a pair of retractable legs 34 for maintaining the bed frame 16 in a substantially horizontal position. The bed frame 16 also supports the mattress 18, and is sized and configured to nest within the shell 12 when in the closed position as shown in FIG. 2. Preferably, the mattress 18 is secured to the bed frame 16 in a conventional manner such as by a mattress strap (not shown) which passes around the mattress and is secured at either end to an anchor (not shown). With the strap in place, the mattress 18 will not move during rotation of the bed frame 16 between the open and closed positions. The pivot assembly 54 is located near the head end 72 of the bed frame 16.

An axle bracket 56, mounted to each side wall 28 of the shell 12, rotatably mounts the corresponding pivot assembly 54 to the shell 12 and supports the bed frame 16. The preferred distance from the head end 72 to the pivot assembly 54 will depend upon the size and weight of the bed frame 16 and mattress 18 and the spring rate of the gas spring 22. Each axle assembly 56 includes an axle 70 and a finger 68. The axles 70 receive the pivot assemblies 54 by conventional bushings and bearings (not shown). Each finger 68 is inferior to and off-set from the axle 70 toward the foot end 74 of the frame 16, and secures one of a pair of actuating links 88, which in tandem cause the legs 34 to slide and rotate in the brackets 80 as explained below.

As shown in FIG. 3, each adjustable shell bracket assembly 48 includes an L-shaped fixed member 90 and an L-shaped slidable member 92. Each fixed member 90 includes a pair of fixed threaded fasteners 96 and a plurality of mounting apertures 130 in a base 104, and a threaded aperture (not shown) in a flange 108. The mounting apertures 130 receive fasteners (not shown) for securing the member 90 to the side wall 28.

Each slidable member 92 includes a base 106 having a ball stud 94, a pair of oblong slots 102, and a flange 110. The mounting apertures 130 of the fixed member 90 of each adjustable bracket assembly 48 receive means of securing (not shown) the adjustable bracket assembly 48 to the respective side wall 28, whereby the long axis of the oblong slots 102 are substantially vertical. The threaded fasteners 96 of the fixed member 90 are received within the slots 102 such that the bases 104 and 106 are adjacent to each other and the flanges 108 and 110 are proximate each other. The slidable member 92 thus slides over the fasteners 96 relative to the fixed member 90. The slidable member 92 may be secured against movement relative to the fixed member 90 by threading hex nuts 98 onto the threaded fasteners 96 with washers (not shown) therebetween.

The ball stud 94 receives and secures the base 120 of the gas spring 122 to the slidable member 92. It will be understood that the spring 122 tends to bias the slidable member 92 upwardly in FIG. 3. The threaded aperture (not shown) in the flange 108 of the fixed member 90 receives a bolt 134, which when turned the appropriate direction in the threaded aperture 100 contacts the flange 110 of the slidable member 92 to resist its upward bias. When the hex nuts 98 are loosened, continued turning of the bolt in one direction will urge the slidable member in a downwardly direction. Turning the bolt in the opposite direction permits the spring bias to urge the slidable member in an upwardly direction. Thus, the position of the base pivot of the gas spring 22 relative to the shell 12 is adjustable. Indeed, precise adjustments can be achieved.

Looking now at FIG. 4, the adjustable bed bracket assembly 50 is mounted to the pivot assembly 54 on the bed frame 16. Like the shell bracket assembly 48, the bed bracket assembly comprises an L-shaped fixed member 90' and an L-shaped slidable member 92'. The L-shaped fixed member 90' includes a base 104' and a flange 108'. The base 104' is mounted to the pivot assembly 54. Of course, the invention also contemplates a variation of the foregoing where the fixed member 90' is integral with the pivot assembly 54, the base 104' being an extension of the pivot assembly 54 itself, and the flange 108' extending outwardly therefrom. The flange 108' will include a threaded aperture (not shown) and a pair of threaded fasteners 96' extending from the base 104'.

Each slidable member 92' includes a base 106' having a ball stud 94', a pair of oblong slots 102', and a flange 110'. The threaded fasteners 96' of the fixed member 90' are received within the slots 102', which are oriented substantially vertical when the bed frame 16 is in then position, such that the bases 104' and 106' are adjacent to each other and the flanges 108' and 110' are proximate each other. The slidable, member 92' thus slides over the fasteners 96' relative to the fixed member 90'. The slidable member 92' may be secured against movement relative to the fixed member 90' by threading hex nuts 98' onto the threaded fasteners 96' with washers (not shown) therebetween.

Figure 5:
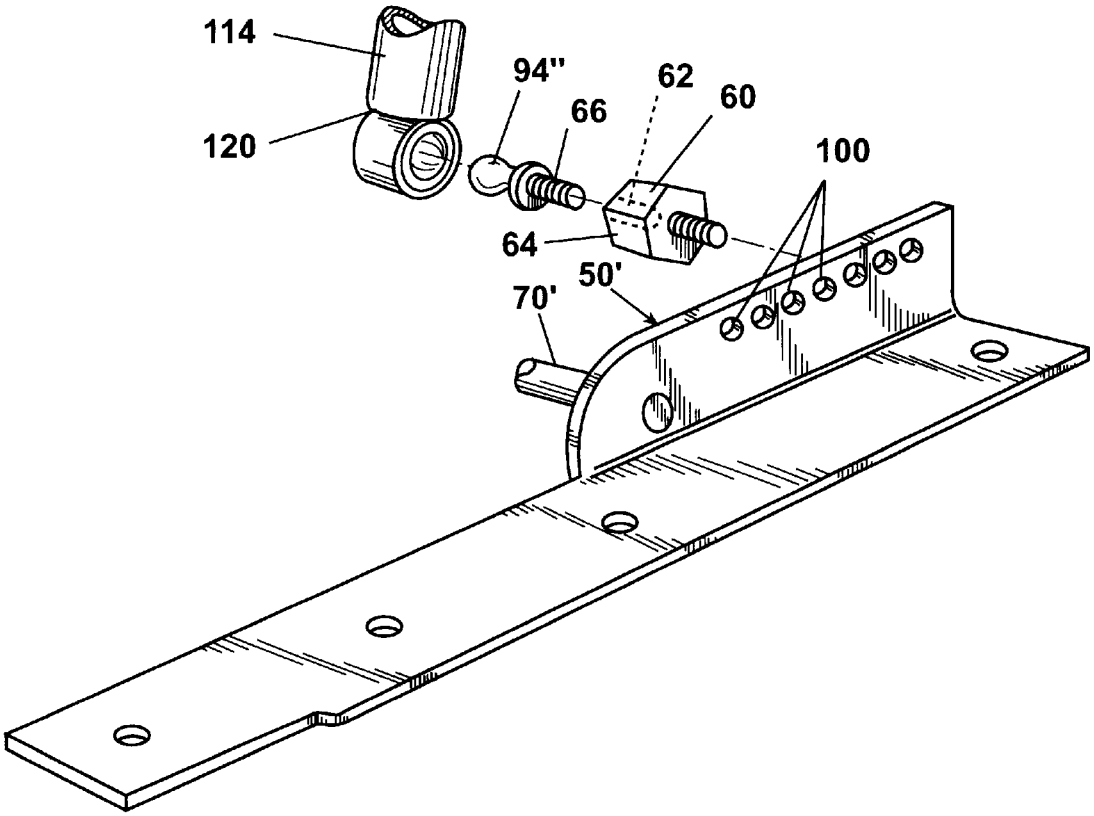
FIG. 5 is an exploded view of an alternative embodiment of a bracket assembly according to the invention.

Alternatively as shown in FIG. 5, the lower adjustable bracket assembly 50' is integral with an axle 70' for rotatably mounting the bed frame 16 to the shell 12 via the bracket assemblies 54 mounted to walls 28. The adjustable bracket assembly 50' includes a series of threaded mounting apertures 100 equidistantly spaced at preferably quarter-inch increments. Six threaded apertures 100 are shown in the preferred embodiment, but more or less can be provided as needed. Further, the spacing between threaded apertures 100 can be increased or decreased according to the particular assembly requirements. The threaded apertures 100 receive a connector 60 that, in turn, mounts a ball stud 94". The installer selects the appropriate threaded aperture 100 for mounting the connector 60, which includes a threaded aperture 62 at its outer end 64, according to the weight of the bed from the strength of the gas spring 22, and the desired flow of the bed frame 16 from an open to closed position and vice versa. The ball stud 94", which supports the base 120 of the piston arm 114 of the gas spring 22 as in the other embodiment, includes a threaded end 66 that can be securely The gas springs 22 bias the bed frame 16 toward a vertical position in accordance with well-known conventional devices. As shown in FIGS. 1 and 2, each gas spring 22 is partially enclosed within a corresponding sheath 112 and includes a reciprocally movable piston arm 114. The piston arm 114 extends from a base 120 of the gas spring 22 and includes a mounting eyelet 116 at a distal end thereof. The mounting eyelets 116 pivotably mount the piston arm 114 of each gas spring 22 to the bed bracket assembly 50. Each base 120 of the gas springs 22 is pivotably mounted to the adjustable shell bracket assembly 48.

The bed frame 16 is rotatably mounted within the shell 12 by a pair of pivot assemblies 54, one side of which is as shown in FIGS. 1, 2, and 4. The bed frame 16, which has a head end 72 and a foot end 74, includes a pair of retractable legs 34 for maintaining the bed frame 16 in a substantially horizontal position. The bed frame 16 also supports the mattress 18, and is sized and configured to nest within the shell 12 when in the closed position as shown in FIG. 2. Preferably, the mattress 18 is secured to the bed frame 16 in a conventional manner such as by a mattress strap (not shown) which passes around the mattress and is secured at either end to an anchor (not shown). With the strap in place, the mattress 18 will not move during rotation of the bed frame 16 between the open and closed positions. The pivot assembly 54 is located near the head end 72 of the bed frame 16.

An axle bracket 56, mounted to each side wall 28 of the shell 12, rotatably mounts the corresponding pivot assembly 54 to the shell 12 and supports the bed frame 16. The preferred distance from the head end 72 to the pivot assembly 54 will depend upon the size and weight of the bed frame 16 and mattress 18 and the spring rate of the gas spring 22. Each axle assembly 56 includes an axle 70 and a finger 68. The axles 70 receive the pivot assemblies 54 by conventional bushings and bearings (not shown). Each finger 68 is inferior to and off-set from the axle 70 toward the foot end 74 of the frame 16, and secures one of a pair of actuating links 88, which in tandem cause the legs 34 to slide and rotate in the brackets 80 as-explained below.

As shown in FIG. 3, each adjustable shell bracket assembly 48 includes an L-shaped fixed member 90 and an L-shaped slidable member 92. Each fixed member 90 includes a pair of fixed threaded fasteners 96 and a plurality of mounting apertures 130 in a base 104, and a threaded aperture (not shown) in a flange 108. The mounting apertures 130 receive fasteners (not shown) for securing the member 90 to the side wall 28.

Each slidable member 92 includes a base 106 having a ball stud 94, a pair of oblong slots 102, and a flange 110. The mounting apertures 130 of the fixed member 90 of each adjustable bracket assembly 48 receive means of securing (not shown) the adjustable bracket assembly 48 to the respective side wall 28, whereby the long axis of the oblong slots 102 are substantially vertical. The threaded fasteners 96 of the fixed member 90 are received within the slots 102 such that the bases 104 and 106 are adjacent to each other and the flanges 108 and 110 are proximate each other. The slidable member 92 thus slides over the fasteners 96 relative to the fixed member 90. The slidable member 92 may be secured against movement relative to the fixed member 90 by threading hex nuts 98 onto the threaded fasteners 96 with washers (not shown) therebetween.

The ball stud 94 receives and secures the base 120 of the gas spring 122 to the slidable member 92. It will be understood that the spring 122 tends to bias the slidable member 92 upwardly in FIG. 3. The threaded aperture (not shown) in the flange 108 of the fixed member 90 receives a bolt 134, which when turned the appropriate direction in the threaded aperture 100 contacts the flange 110 of the slidable member 92 to resist its upward bias. When the hex nuts 98 are loosened, continued turning of the bolt in one direction will urge the slidable member in a downwardly direction. Turning the bolt in the opposite direction permits the spring bias to urge the slidable member in an upwardly direction. Thus, the position of the base pivot of the gas spring 22 relative to the shell 12 is adjustable. Indeed, precise adjustments can be achieved.

Looking now at FIG. 4, the adjustable bed bracket assembly 50 is mounted to the pivot assembly 54 on the bed frame 16. Like the shell bracket assembly 48, the bed bracket assembly comprises an L-shaped fixed member 90' and an L-shaped slidable member 92'. The L-shaped fixed member 90' includes a base 104' and a flange 108'. The base 104' is mounted to the pivot assembly 54. Of course, the invention also contemplates a variation of the foregoing where the fixed member 90' is integral with the pivot assembly 54, the base 104' being an extension of the pivot assembly 54 itself, and the flange 108' extending outwardly therefrom. The flange 108' will include a threaded aperture (not shown) and a pair of threaded fasteners 96' extending from the base 104'.

Each slidable member 92' includes a base 106' having a ball stud 94', a pair of oblong slots 102', and a flange 110'. The threaded fasteners 96' of the fixed member 90' are received within the slots 102', which are oriented substantially vertical when the bed frame 16 is in the open position, such that the bases 104' and 106' are adjacent to each other and the flanges 108' and 110' are proximate each other. The slidable member 92' thus slides over the fasteners 96' relative to the fixed member 90'. The slidable member 92' may be secured against movement relative to the fixed member 90' by threading hex nuts 98' onto the threaded fasteners 96' with washers (not shown) therebetween.

Alternatively as shown in FIG. 5, the lower adjustable bracket assembly 50' is integral with an axle 70' for rotatably mounting the bed frame 16 to the shell 12 via the bracket assemblies 54 mounted to walls 28. The adjustable bracket assembly 50' includes a series of threaded mounting apertures 100 equidistantly spaced at preferably quarter-inch increments. Six threaded apertures 100 are shown in the preferred embodiment, but more or less can be provided as needed. Further, the spacing between threaded apertures 100 can be increased or decreased according to the particular assembly requirements. The threaded apertures 100 receive a connector 60 that, in turn, mounts a ball stud 94". The installer selects the appropriate threaded aperture 100 for mounting the connector 60, which includes a threaded aperture 62 at its outer end 64, according to the weight of the bed from the strength of the gas spring 22, and the desired flow of the bed frame 16 from an open to closed position and vice versa. The ball stud 94", which supports the base 120 of the piston arm 114 of the gas spring 22 as in the other embodiment, includes a threaded end 66 that can be securely fastened to the aperture 62 of the connector 60. Thus, the position of the base 120 of the gas spring 22 relative to the shell 12 is adjustable.

In the first embodiment, as best shown in FIG. 4, the ball stud 94' receives and secures the base 120 at the end of the piston arm 114 of the gas spring 22 to the slidable member 92'. It will be understood that the spring 22 tends to bias the slidable member 92' upwardly in FIG. 3. The threaded aperture (not shown) in the flange 108' of the fixed member 90' receives a bolt 134', which when turned the appropriate direction in the threaded aperture 100' contacts the flange 110' of the slidable member 92' to resist its upward bias. When the hex nuts 98' are loosened, continued turning of the bolt in one direction will urge the slidable member in a downwardly direction. Turning the bolt in the opposite direction permits the spring bias to urge the slidable member in an upwardly direction. Thus, the position of the base pivot of the gas spring 22 relative to the shell 12 is adjustable. Indeed, precise adjustments can be achieved.

The mounting apertures 130 of each fixed member 90 of each bracket assembly 50 receive means of securing (not shown) the adjustable bracket assembly 50 to the bed frame 16, whereby the long axes of the oblong slots 102 are substantially parallel to the bed frame 16.

Figure 6:
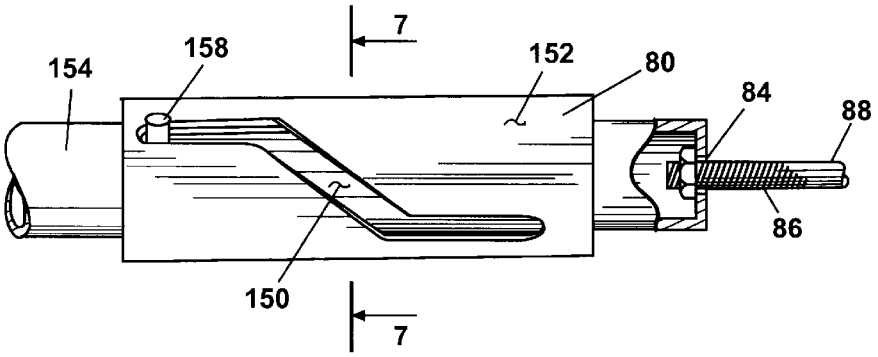
FIG. 6 is an enlarged side view, partly in section, of the area bounded by phantom line VI in FIG. 1.
Figure 7:
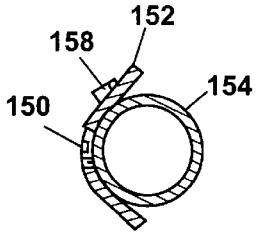
FIG. 7 is a cross-sectional view taken along lines 7—7 of FIG. 6.

Looking now at FIGS. 1, 6, and 7, the retractable legs 34 are attached by a pair of brackets 80 to either side of the bed frame 16 adjacent the foot end 74. Each bracket 80, as shown in FIG. 6, has a convex outer face 152 with a substantially Z-shaped slot 150 therein. Each leg 34 is L-shaped, and includes an upper portion 154 and a lower portion 156. The upper portion 154 freely slides within the bracket 80 and is rotatably connected at one end to the actuating link 88. The upper portion 154 further includes a pin 158, extending normally therefrom and adapted to travel in the slot 150. The actuating link 88, which includes a threaded end 86 for adjustably mounting to a threaded aperture 84 in the upper portion 154 of the leg 34, connects the leg 34 to the finger 68 on the respective axle assembly 56.

When the bed frame 16 is pivoted to its closed or substantially vertical position, the upper portion 154 is pulled through the bracket 80 by the link 88 so that the pin 158 slides in the slot 150 in the convex face 152. The shape of the slot 150 and its interrelation with the moving pin 158 urges the leg 34 to rotate 90 degrees by the time the bed reaches the closed position. Thus, when the pin 158 is furthest from the head end 72 of the bed frame 16, the legs 34 extend vertically to support the bed frame 16. However, the pin 158 is closest to the head end 72 of the bed frame 16 the legs 34 retract horizontally beneath the bed frame 16 for storage. The movement of the pin 158 in the slot 150 can be precisely adjusted by threading the end 86 in or out of the aperture 84 in the upper portion 154 of the leg 34 and locking its position by tightening a hex nut 82 against the aperture perimeter 78.

When the bed frame 16 is in the closed position, the gas spring 22 is extended; i.e., the base 120 and the eyelet 116 of the piston arm 114 are furthest from each other. When the bed frame 16 is in the open position, the gas spring 22 is compressed; i.e., the base 120 and the eyelet 116 of the piston arm 114 are closest to each other. As the bed frame is moved toward a closed position, the gas springs 22 resist movement of the bed frame 16 such that the downward movement is slowed but not stopped.

The balance in "flow" of the bed frame 16 as it lowers is achieved by properly mounting the eyelet 116 and base 120 of each gas spring 22 in the adjustable bracket assemblies 48, 50, respectively. If the distance between the points of connection of the eyelet 116 and base 120 is greater than optimum, the flow will be fast, which could cause injury to the bed assembly 10 or to a person using the assembly. If the distance between the connection points is less than optimum, the flow will be slow or nonexistent, which makes the bed assembly 10 difficult or impossible to use.

The adjustable shell bracket assemblies 48, which are secured to side walls 28 of the shell 12, and the adjustable bed bracket assemblies 50, which are secured to the bed frame 16, permit tuning of the pivotable connection of the bed frame 16 to the shell 12. Upon initial installation of the gas springs 22, the optimum distance between the adjustable bracket assemblies is difficult to predict. To ease this installation, the bracket assemblies 48 and 50 can be adjusted to shorten or lengthen this distance by loosening hex nuts 98, 98' on the threaded fasteners 96, 96' so that the threaded fasteners can slide in the slots 102, 102' and the slidable members 92, 92' can slide relative to the fixed members 90, 90'. When the correct position is determined, the hex nuts 98, 98' can be retightened on the threaded fasteners so that the slidable member is secured against movement relative to the fixed member 90.

Moreover, more precise adjustments to the bracket assemblies 48, 50 can be made by threading bolt 134, which when turned in the threaded aperture 100 strikes the flange 110 of the slidable member 92 and causes the slidable member 92 to move. When the slidable member 92 moves, the threaded fasteners 96 of the fixed member 90 slide slightly in the slots 102, whereby more a precise adjustment to the bracket assembly 48, 50 is achieved. Thus, when the flow of the bed frame 16 from its open to closed position changes with use, as is common, the bracket assemblies 48 and 50 can be adjusted to lengthen or shorten the distance between the eyelet 116 of the piston arm 114 and the base 120, whereby the proper flow can be restored.

In the alternative embodiment shown in FIG. 5, the adjustments to the lower bracket assembly 50' are made by mounting the connector 60 in the appropriate threaded aperture 100. Any further adjustments to the flow of the bed frame 16 can be made by adjusting the upper bracket assembly 48 in the manner described above. Also, during manufacture, the spacing between threaded apertures 100 can be increased or decreased to anticipate particular assembly requirements. The installed connector 60, in turn, mounts a ball stud 94" by threading the end 66 of the ball stud 94" into the aperture 62 of the connector 60. As in the other embodiments, the ball stud 94" supports the base 120 of the piston arm 114 of the gas spring 22.

As the bed frame 16 is lowered and raised, the legs 34 are lowered and rotated outwardly, and raised and rotated inwardly, respectively. As shown in FIG. 1, each finger 68 is inferior to and off-set from the axle 70 toward the foot end 74 of the frame 16, whereby the distance from the foot end 74 of the bed frame 16 to the finger 68 increases when the bed frame 16 is rotated on axle 70 from the open to closed position. The change in length causes the fixed-length actuating link 88 to pull the pins 158 of the legs 34 toward the finger 68, as shown in FIGS. 1 and 2, whereby the pins 158 slide toward the pivot assembly 54 and rotate inwardly in the convex brackets 80 causing the legs 34 to rotate similarly until the legs 34 are coplanar with the bed frame 16.

It should be understood that various modifications of the preferred embodiment will become apparent to those skilled in the art.

While the invention has been specifically described in connection with certain specific embodiments thereof, it is to be understood that this is by way of illustration and not of limitation, and the scope of the appended claims should be construed as broadly as the prior art will permit.

What is claimed is:

1. In a spring counterbalanced folding wall bed comprising a vertically disposed shell having side walls spaced from each other, a bed frame having a head end, the bed frame being pivotally mounted to the shell for movement between an open position where the bed frame is substantially horizontal and a closed position where the bed frame is substantially vertical and between the side walls, and a spring mounted between the head end and one of the side walls and biased to retain the bed in the closed position, a first end of the spring being secured to the head end by a first pivotal connection and a second end of the spring being secured to the side wall by a second pivotal connection, the improvement wherein:

the first pivotal connection comprises a bracket assembly including a fixed plate mounted to the bed frame, and a slidable plate having a boss thereon and at least one longitudinal slot therein, the first end of the spring being mounted to the boss, the fixed plate having a first flange and the slidable plate having a second flange substantially parallel to the first flange, and further comprising a bolt threaded through the first flange and in contact with the second flange in a position to urge the slidable plate in a direction against the spring bias when the bolt is turned so that the distance between the first end and the second end of the spring can be adjusted.

2. In a spring counterbalanced folding wall bed comprising a vertically disposed shell having side walls spaced from each other, a bed frame having a head end, the bed frame being pivotally mounted to the shell for movement between an open position where the bed frame is substantially horizontal and a closed position where the bed frame is substantially vertical and between the side walls, and a spring mounted between the head end and one of the side walls and biased to retain the bed in the closed position, a first end of the spring being secured to the head end by a first pivotal connection and a second end of the spring being secured to the side wall by a second pivotal connection, the improvement wherein:

the second pivotal connection comprises a bracket assembly including a fixed plate mounted to one of the side walls, and a slidable plate having a boss thereon and at least one longitudinal slot therein, the second end of the spring being mounted to the boss, the fixed plate having a first flange and the slidable plate having a second flange substantially parallel to the first flange, and further comprising a bolt threaded through the first flange and in contact with the second flange in a position to urge the slidable plate in a direction against the spring bias when the bolt is turned so that the distance between the first end and the second end of the spring can be adjusted.

3. In a spring counterbalanced folding wall bed comprising a vertically disposed shell having side walls spaced from each other, a bed frame having a head end, the bed frame being pivotally mounted to the shell for movement between an open position where the bed frame is substantially horizontal and a closed position where the bed frame is substantially vertical and between the side walls, and a spring mounted between the head end and one of the side walls and biased to retain the bed in the closed position, a first end of the spring being secured to the head end by a first pivotal connection and a second end of the spring being secured to the side wall by a second pivotal connection, the improvement wherein:

the second pivotal connection comprises a bracket assembly including a fixed plate mounted to one of the side walls, and a slidable plate having a boss thereon and at least one longitudinal slot therein, the second end of the spring being mounted to the boss, the fixed plate having a threaded fastener extending therefrom, the longitudinal slot being received over the threaded fastener and wherein a nut on the fastener can selectively fix the slidable plate to the fixed plate on the side wall at a predetermined vertical displacement relative to the bed frame so that the distance between the first end and the second end of the spring can be adjusted.

* * * * *